US012378823B2

(12) United States Patent
Randle et al.

(10) Patent No.: US 12,378,823 B2
(45) Date of Patent: Aug. 5, 2025

(54) SEAL SYSTEM

(71) Applicant: Dynomax Drilling Tools Inc., Leduc (CA)

(72) Inventors: Hartley Randle, Spruce Grove (CA); Brandon Jullion, Beaumont (CA); Alaric Tomas, Sherwood Park (CA); Joshua Gamble, Spruce Grove (CA)

(73) Assignee: Dynomax Drilling Tools Inc., Leduc (CA)

( * ) Notice: Subject to any disclaimer, the term of this patent is extended or adjusted under 35 U.S.C. 154(b) by 284 days.

(21) Appl. No.: 17/937,103

(22) Filed: Sep. 30, 2022

(65) Prior Publication Data

US 2023/0130532 A1 Apr. 27, 2023

(30) Foreign Application Priority Data

Oct. 26, 2021 (CA) ..... CA 3135984

(51) Int. Cl.
*E21B 4/00* (2006.01)
*E21B 4/02* (2006.01)

(52) U.S. Cl.
CPC ..... *E21B 4/003* (2013.01); *E21B 4/02* (2013.01)

(58) Field of Classification Search
CPC ..... E21B 4/003
See application file for complete search history.

(56) References Cited

U.S. PATENT DOCUMENTS 3,730,284 A 5/1973 Striegler
3,837,631 A 9/1974 Evans et al.
3,901,517 A 8/1975 Heathcott
4,114,703 A 9/1978 Matson, Jr. et al.
4,133,542 A 1/1979 Janian et al.
4,225,000 A 9/1980 Maurer
4,324,299 A 4/1982 Nagel
4,476,944 A 10/1984 Beimgraben
4,484,753 A 11/1984 Kalsi
4,508,356 A 4/1985 Janian
4,577,704 A 3/1986 Aumann
4,593,774 A 6/1986 Lingafelter
4,683,964 A 8/1987 Wenzel
(Continued)

FOREIGN PATENT DOCUMENTS

BR 112013019051 A2 2/2017
CA 2633403 C 9/2011
(Continued)

OTHER PUBLICATIONS

"The LKS High PV Seal: Better Performance and Predictability", Downloaded from www.balseal.com, Jun. 2021; p. 1-12.
(Continued)

*Primary Examiner* — Kristyn A Hall

(57) ABSTRACT

A sealed bearing system has a pressure-retaining seal separating two lubricating chambers, one pressure balanced to the outside and the other pressure balanced to the inside. The pressure retaining seal may be a non pumping seal. Radial bearings may be mounted near either axial side of the seal to prevent deflection. The pressure-retaining seal may include a flange and the flange may be axially compressed between a seal carrier and a portion of an outer tubular to fix the seal to the outer tubular. The seal and seal carrier may be installed using a mandrel on which they are temporarily positioned in order to insert and install them into the outer tubular.

9 Claims, 11 Drawing Sheets

(56) References Cited

U.S. PATENT DOCUMENTS

| | | | |
|---|---|---|---|
| 4,939,830 | A | 7/1990 | Janian |
| 5,217,080 | A | 6/1993 | Wenzel et al. |
| 5,248,204 | A | 9/1993 | Livingston et al. |
| 5,337,840 | A | 8/1994 | Chancey et al. |
| 5,377,771 | A | 1/1995 | Wenzel |
| 5,979,904 | A | 11/1999 | Balsells |
| 5,992,856 | A | 11/1999 | Balsells et al. |
| 6,120,036 | A | 9/2000 | Kalsi et al. |
| 6,161,838 | A | 12/2000 | Balsells |
| 6,250,806 | B1 | 6/2001 | Beshoory |
| 6,315,302 | B1 | 11/2001 | Conroy et al. |
| 6,416,225 | B1 | 7/2002 | Cioceanu et al. |
| 7,798,496 | B2 | 9/2010 | Dietle et al. |
| 8,181,720 | B2 | 5/2012 | Prill et al. |
| 9,086,151 | B2 | 7/2015 | Dietle et al. |
| 9,683,409 | B2 | 6/2017 | Marchand |
| 9,863,195 | B2 | 1/2018 | Peer et al. |
| 10,302,200 | B2 | 5/2019 | Dietle |
| 2002/0153664 | A1 | 10/2002 | Schroeder |
| 2012/0195542 | A1 | 8/2012 | Marchand |
| 2014/0312570 | A1 | 10/2014 | Foster |
| 2016/0047473 | A1 | 2/2016 | Foster et al. |

FOREIGN PATENT DOCUMENTS

| | | | |
|---|---|---|---|
| CA | 2825027 | A1 | 8/2012 |
| WO | 2002079676 | | 10/2002 |

OTHER PUBLICATIONS

"Solutions for Rotary Applications", Downloaded from www.balseal.com. Oct. 2021; p. 1-32.

Excerpt from "Rotary Seal Design Guide", Catalog EPS 5350/USA; Downloaded from https://www.parker.com/literature/Engineered%20Polymer%20Systems/5350.pdf; Mar. 28, 2006; p. "11-11".

"Graphite-Filled Polytetrafluoroethylene (G);", Downloaded from www.balseal.com, Jun. 2021; p. 1.

"Graphite Fiber—Reinforced Polytetrafluoroethylene (GFP55)", Downloaded from www.balseal.com, Jun. 2021; p. 1.

Excerpt from Trelleborg Sealing Solutions Catalog, Oil and Gas Sealing Systems; Product Catalog and Engineering Guide, "Turcon® Roto Variseal®", Jun. 2018; p. 269-275.

Kalsi Seals Handbook, "Chapter 3; Using Kalsi Seals in Mud Motors";,Oct. 16, 2015; Document 3281; p. 1-14.

Saudi Authority for Intellectual Property, Substantive Examination Report issued Nov. 2, 2023 regarding Application No. 122440432, 14 pages.

SEAL SYSTEM

CROSS-REFERENCE TO RELATED APPLICATIONS

This application is based on and claims priority under 35 U.S.C. 119 to Canadian Application No. 3,135,984, filed on Oct. 26, 2021, in the Canadian Patent Office, the disclosure of which is herein incorporated by reference in their entirety.

TECHNICAL FIELD

Sealing bearing systems in downhole rotary devices, such as mud motors.

BACKGROUND

In drilling a subterranean formation; such as in the drilling of an oil well; it is common practice to use a combination of downhole tools, including; but not limited to; a drill bit, a rotary steerable system (RSS), a downhole motor, measuring while drilling tools (MWD), collars and drill pipe. These components make up the 'drill string' which is often rotated from the surface, with the mud motor providing additional speed and torque to the RSS and drill bit. The RSS functions to 'steer' the drill bit, and allows the operator to create complex wellbore geometries and optimize well production.

When two tubular elements need to have a relative axial rotation downhole, such as in a mud motor, the tubular elements are typically mounted for relative axial rotation using bearings located between the tubular elements. Unless carefully sealed, mud will flow between the tubular elements. In some bearing arrangements, known as mud lubricated bearings, this flow is tolerated, but this results in exposure of the bearings to potentially abrasive drilling mud as well as some pressure loss.

Many RSS tools have limited steering capacity, based on the flow rate and pressure drop across the drill bit. For this reason, it is desirable to have a downhole motor that does not bypass any drilling fluid, thereby providing the maximum amount of flow (and a constant amount of flow) to the RSS. To do this a downhole motor must have a 'sealed bearing pack' as opposed to a 'mud-lubricated' bearing pack, which by necessity means sealing the bearings in a lubricating fluid from the drilling mud.

In sealed bearings, the bearings are enclosed in a chamber holding lubricant. As the bearings need to connect between the relatively axially rotating tubulars, the seals defining this chamber need to also connect between these moving parts. There are several challenges that must be met by sealed bearings. The difference in pressure between the interior bore of the inner tubular and the exterior of the outer tubular can be significant, requiring at least one seal to bear substantial pressure. Also, any seal between mud and lubricant can be exposed to abrasive materials from the drilling mud.

Commonly, pumping seals are used in sealed bearings. Pumping seals slowly pump lubricant from one side of the seal to the other side of the seal. This reduces friction and protects the seal from abrasive materials on the non-lubricant side of the seal. However, withstanding very large pressure differences with pumping seals is difficult. Also, if a pumping seal is used in a location with lubricant on both sides, it may overfill the lubricant on the side to which it pumps.

Some sealed bearings use complex mechanical seals to withstand high pressures differences. The mechanical seals use springs to press rigid elements axially together to slide against each other at flat, axially facing surfaces. These seals are expensive to construct.

Kalsi™ Engineering Inc. has disclosed bearing systems using pumping seals. In systems with two lubricant volumes, using a pumping seal between the lubricant volumes may use up one of the lubricant volumes faster (and potentially "over-pump") the other, reducing system life.

Generally, sealing systems face one of four main challenges:

1. High Temperature (Of which downhole tools only marginally deal with, other applications are much hotter)
2. High Differential Pressure
3. Dirty Environments
4. Poor alignments Downhole tools will face the last three, and the first one to a certain extent. Most individual seals are incapable of addressing all of these at once. It is advantageous to reduce the number of these challenges that each individual seal needs to address.

SUMMARY

There is disclosed in one embodiment a sealed bearing system for sealing between and rotatably connecting an outer tubular and an inner tubular telescopically received in the outer tubular. The inner and outer tubulars define an interior bore extending axially within the tubulars. There is a lubricant chamber between the outer tubular and the inner tubular. An outer volume is exterior to the inner and outer tubulars. The sealed bearing system has thrust bearings within the lubricant chamber for transferring axial loads between the tubulars. There is a non-pumping seal arranged as a pressure retaining seal within the lubricant chamber to separate the lubricant chamber into a first pressure portion and a second pressure portion. The non-pumping seal is fixed between a seal carrier and a portion of the outer tubular. Radial bearings within the lubricant chamber allow for axially aligning the tubulars for coaxial relative rotation. The radial bearings include a first radial bearing connecting the seal carrier to the inner tubular and a second radial bearing connecting the inner tubular to the outer tubular. The first radial bearing and the second radial bearing are arranged in opposite axial directions from the non-pumping seal. A first pressure equalizing element is arranged to substantially equalize a pressure in the first pressure portion to a pressure in the outer volume. A first end seal seals between the first pressure portion and the outer volume and defines a first end of the lubricant chamber. A second pressure equalizing element is arranged to substantially equalize a pressure in the second pressure portion to a pressure in the interior bore. A second end seal seals between the second pressure portion and the interior bore and defines a second end of the lubricant chamber.

In various embodiments, there may be included any one or more of the following features: the radial bearings comprise bushings; the second radial bearing is separated from the non-pumping seal by an axial distance less than an axial length of the second radial bearing; the first end seal comprises a first pumping seal and the second end seal comprises a second pumping seal; the first end seal comprises a first wiper seal and a first pumping seal, and the second end seal comprises a second wiper seal and a second pumping seal; the first pressure equalizing element comprises a first piston separating the first pressure portion from a first chamber fluidly connected to the outer volume and the second pressure equalizing element comprises a second piston separating the second pressure portion from a second chamber fluidly connected to the interior bore; the first end seal is mounted on the first piston and the second end seal is mounted on the second piston; the non-pumping seal is configured to extend circumferentially around the inner tubular member and has a cross section comprising a C-shaped portion having first and second branches extending from a root portion, the first branch of the C-shaped portion having a contact surface facing an outward radial direction and adapted to stationary contact with the outer tubular member, the second branch of the C-shaped portion including a sealing surface on a side away from the second branch, the sealing surface facing in an inward radial direction and adapted to moving contact with the inner tubular member, the seal adapted to have the root portion of the C-shaped portion facing an expected direction of relatively lower pressure in use, the seal further comprising a spring between the first and second branches biasing the first and second branches apart; and the non-pumping seal also has a flange extending radially outward from the root portion, the flange adapted to be compressed by the seal carrier against an axially facing surface 80 of the outer tubular to fix the seal with respect to the outer tubular.

There is disclosed in one embodiment a seal for sealing between an outer tubular and an inner tubular coaxial with and arranged for coaxial rotation within the outer tubular. The seal is configured to extend circumferentially around the inner tubular and has a cross section comprising a C-shaped portion having outer and inner branches extending from a root portion. The outer branch of the C-shaped portion has a contact surface facing an outward radial direction and adapted to stationary contact with the outer tubular. The inner branch of the C-shaped portion includes a sealing surface on a side away from the second branch. The sealing surface faces in an inward radial direction and is adapted to moving contact with the inner tubular. The seal is adapted to have the root portion of the C-shaped portion facing an expected direction of relatively lower pressure in use. The seal includes a spring between the outer and inner branches biasing the outer and inner branches apart. A flange extends radially outward from the root portion. The flange is adapted to be compressed by a seal carrier against an axially facing surface of the outer tubular to fix the seal with respect to the outer tubular.

In various embodiments, there may be included any one or more of the following features: the seal is a non-pumping seal; the seal comprises polytetrafluoroethylene (PTFE); the PTFE further comprises a reinforcement material; and the seal has a seal carrier having a radially outward facing surface including threading for engaging with threading on an inner surface of the outer tubular to compress the flange.

Any of these seals may be mounted as a pressure retaining seal in a lubricant chamber in a lubricant chamber, in accordance for example with any sealed bearing system disclosed in this document. In one example, the lubricant chamber may be divided into first and second pressure portions by the pressure retaining seal, a first end seal sealing between the first pressure portion and an outer volume and defining a first end of the lubricant chamber, a first pressure equalizing element arranged to substantially equalize a pressure in the first pressure portion to a pressure in the outer volume, a second end seal sealing between the second pressure portion and an interior bore of the inner tubular and defining a second end of the lubricant chamber, and a second pressure equalizing element may be arranged to substantially equalize a pressure in the second pressure portion to a pressure in the interior bore. The seal system may be for example, a sealed bearing system comprising bearings mounted within the lubricant chamber. The bearings may include first radial bearings within the first pressure portion and second radial bearings within the second pressure portion. The bearings may include thrust bearings.

There is disclosed in one embodiment a method of installing a seal in a sealed bearing system for sealing between inner and outer tubulars arranged to relatively rotate coaxially. The outer tubular defines a portion of a seal gland. The seal is mounted to a seal carrier. The seal carrier defines another portion of the seal gland. A mandrel is inserted through the seal and seal carrier. The mandrel has a portion having a mandrel diameter substantially matching a diameter of the inner tubular. Features extend beyond the mandrel diameter. The features extending beyond the mandrel diameter mate with corresponding features of the seal carrier. The mandrel is inserted, with the seal and seal carrier mounted to the mandrel, into the outer tubular to install the seal and seal carrier into the outer tubular. The mandrel is removed from the outer tubular, seal and seal carrier. The inner tubular is inserted into the outer tubular, seal and seal carrier.

In various embodiments, there may be included any one or more of the following features: the outer tubular has an internal threaded portion and the seal carrier comprises external threading arranged to engage the internal threaded portion of the outer tubular, installing the seal and seal carrier comprising the mandrel being rotated relative to the outer tubular to cause the external threading of the seal carrier to engage the internal threaded portion of the outer tubular and compress the seal axially between the portion of the seal gland defined by the outer tubular and the portion of the seal gland defined by the seal carrier; the seal comprises a flange extending radially outward from the seal, and in which the step of rotating the mandrel relative to the outer tubular to cause the external threading of the seal carrier to engage the internal threaded portion of the outer tubular and compress the seal axially between the portion of the seal gland defined by the outer tubular and the portion of the seal gland defined by the seal carrier comprises compressing the flange axially between the portion of the seal gland defined by the outer tubular and the portion of the seal gland defined by the seal carrier; the seal has a cross section comprising a C-shaped portion having outer and inner branches extending from a root portion, the outer branch of the C-shaped portion having a contact surface facing an outward radial direction and adapted to stationary contact with the outer tubular, and the inner branch of the C-shaped portion including a sealing surface on a side away from the second branch, the sealing surface facing in an inward radial direction and adapted to moving contact with the inner tubular, the seal adapted to have the root portion of the C-shaped portion facing an expected direction of relatively lower pressure in use; the seal further comprising a spring between the outer and inner branches biasing the outer and inner branches apart; and a flange extending radially outward from the root portion; the flange adapted to be compressed by the seal carrier 3 against an axially facing surface of the outer tubular to fix the seal with respect to the outer tubular; the seal carrier includes a bushing to act as a radial bearing against the inner tubular and before the step of inserting the mandrel through the seal and seal carrier, the method may comprise the step of forming the mandrel from a first piece including the portion having the mandrel diameter that substantially matches the diameter of the inner tubular and a second piece including the features extending beyond the mandrel diameter.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1:
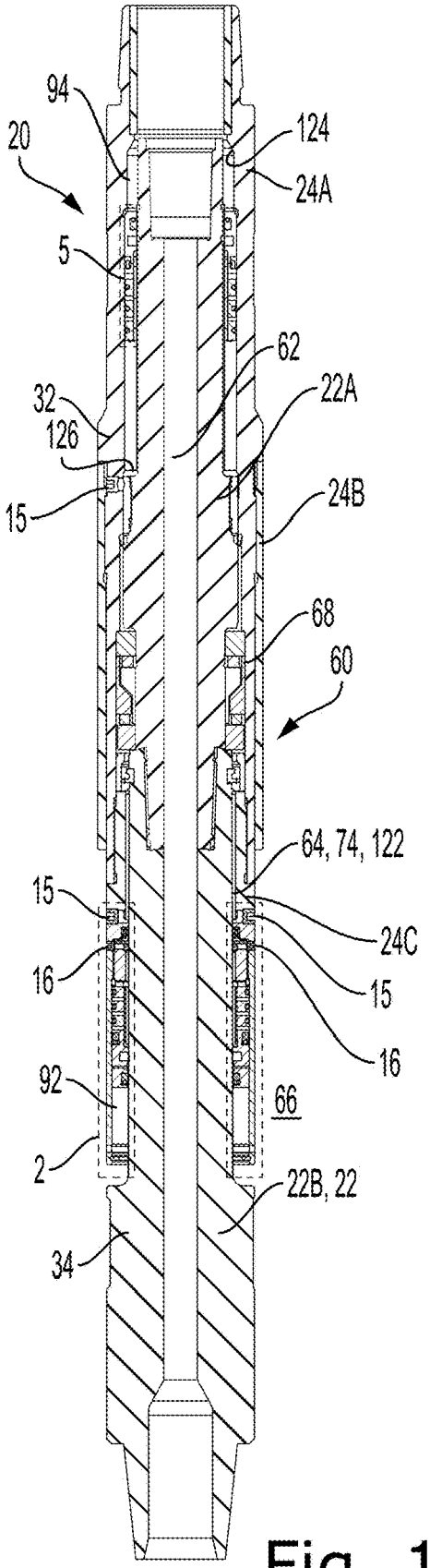
FIG. 1 is a cross section view of an exemplary drilling motor including a sealed bearing system.

FIG. 1 shows a layout of an exemplary drilling motor with sealed bearings. A drilling motor 20 may include one or more inner tubular members 22A, 22B, and one or more outer tubular members 24A, 24B, 24C telescopically arranged. The word "telescopically" here refers to an axial overlap between tubular members one of which is radially within another, and does not necessarily indicate any relative axial motion. A single tubular member may be an inner member and an outer member relative to different other tubular members. Any pair of tubular members arranged telescopically may define three spaces: an interior bore extending axially within the tubular members, an intermediate space between in outer tubular member and the inner tubular member, and an outer volume exterior to the inner and outer tubular members. An inner tubular may also be referred to as a "mandrel" and an outer tubular may also be referred to as a "housing". The term "mandrel" can also include an inner cylindrical object even if solid, though in use a drilling system will typically include only elements with axial bores.

In a drilling motor, a rotary action occurs in which one or more tubulars rotate relative to one or more other tubulars. For tubulars that are fixedly connected to one another, obtaining a seal is relatively trivial. A sealed bearing system can include components adjacent to multiple such fixedly connected tubulars. Therefore, in this document, a "tubular" is also used to refer to one or more tubulars that are fixedly connected to one another. Typically, there will be at least two sets of one or more tubulars, the one or more tubulars of each set fixedly connected to one another, and the two sets collectively telescopically arranged and which must be able to rotate with respect to each other. Hereinafter, the radially inward of these telescopically arranged sets is referred to as the "inner tubular" and the radially outward of these telescopically arranged sets is referred to as the "outer tubular". In the embodiment shown in FIG. 1, inner tubular members 22A, 22B collectively form inner tubular 22, and outer tubular members 24A, 24B, 24C collectively form outer tubular 24. The inner tubular 22 may collectively define an inner bore 62 and the outer tubular may collectively define an inner boundary of an outer volume. The inner tubulars may be sealed and fixed together, and the outer tubulars sealed and fixed together, at threaded connections. In between the tubulars 22, 24 is an intermediate space 122. Drilling fluid is typically pumped down through the inner bore 62 and flows back up through the outer volume. In the intermediate space 122 between these tubulars, a plurality of bearings are arranged. In a sealed bearing system, the bearings are arranged within a lubricant chamber within the intermediate space and seal elements are arranged at least to define the lubricant chamber.

Typically, the seal elements will include a downhole seal which separates the lubricating fluid from the drilling mud external to the tool, and an uphole seal that separates the lubricating fluid from the drilling mud internal to the tool. Between the two seals multiple radial bearing elements (here shown as journal style bearings, but they could be composed of roller or ball bearings) and at least one thrust bearing element 68 (here shown as a roller element bearing, but could be composed of journal, PDC thrust, etc.) may be arranged for transferring radial and axial loads between the mandrel and housings. The thrust bearing can be located on either side of the pressure retaining seal 14 described below, as both sides have an oil volume for lubrication. In this embodiment, it is located uphole of the pressure retaining seal for ease of assembly.

Between the two pistons a pressure retaining seal 14 is placed, for example of the type with an internal cantilever spring, and a PTFE jacket, which divides the area between the two pistons into two oil volumes. The lower oil volume 72 will be acted upon through the lower piston by the drilling fluid external to the housings, resulting in the lower seal having equal pressure on both sides. The upper oil volume 74 will be acted upon through the upper piston by the drilling fluid internal to the tubulars, resulting the upper seal having equal pressure on both sides. The pressure retaining seal will experience a differential pressure, with the upper oil volume being at a higher pressure than the lower oil volume. By the design of this seal, as the differential pressure increases, the seal increases the force with which it makes contact with the mandrel, thereby increasing sealing ability as differential pressure increases. By nature of the outer seals, the inner seal is not required to exclude contaminants, as it has a clean oil volume on each side.

In a preferred embodiment, the pressure retaining seal is located directly between two radial bushings (26 and 27), so that the inner tubular cannot deflect significantly compared with the outer tubular, thereby limiting the misalignment experienced by the seal.

Figure 2:
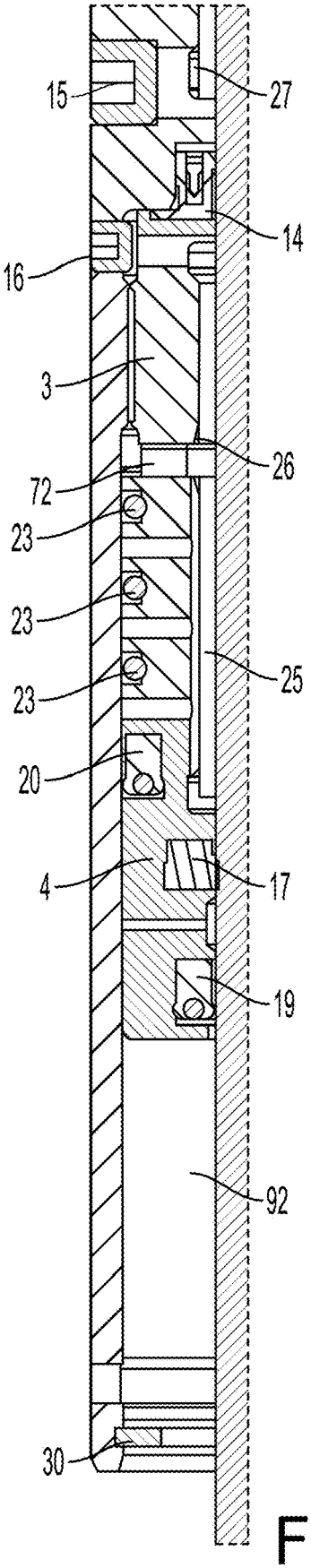
FIG. 2 is a closeup of a piston and pressure retaining seal of the sealed bearing system of FIG. 1.

FIG. 2 shows an exemplary embodiment of a portion of a sealed bearing system. FIG. 2 corresponds to boxed area 2 in FIG. 1. In an embodiment, there is a lower piston 4 that is axially free to float, with the axial position constrained by a retaining ring 30 and the seal carrier 3. The area between the piston and seal carrier composes a first oil volume 72 which in use is at a first pressure. This first oil volume may be filled through a plug 16 (e.g. a standard National Pipe Tapered (NPT) plug) located downhole of a fixed pressure retaining seal 14. Another such plug 15, here of a different size, is shown uphole of the pressure retaining seal to fill the upper oil volume 74. Additional plugs 15 and 16 allow the air to transfer out of one plug while oil is pumped into another plug. The piston has multiple seal elements (20 and 23) that seal between the outer tubular 24 and the piston 4 and provide rotary drag, such that the piston 4 is prevented from rotating relative to the housings. Sealing element 20 excludes contaminants and is the primary seal. Sealing elements 23 are primarily in place to increase friction between piston 4 and the outer tubular 24, thereby preventing rotation between the piston 4 and outer tubular 24, but still allowing for axial movement. Internally the piston in this embodiment has a wiper seal 19 which helps to exclude contaminants, and a rotary seal 17 that pumps the lubricating fluid at a very slow rate when in rotary operation, thereby excluding contaminants. A bypass port may be provided to equalize pressure on either side of the wiper 19, and can be packed with grease that is not easily displaced as the bypass port is very small. A radial bushing 25 may be provided to minimize torsional drag on the ID of the piston 4 allowing the mandrel to rotate with minimal drag. This layout also has the added benefit of preventing relative deflection between the rotary seal 17 and the mandrel, as the piston 4 has room to float on the external seals, and is aligned to the piston by the bushing 25.

In this embodiment, a second piston 5 with identical features to the piston 4 but placed in the opposite axial orientation is located uphole of the radial and thrust bearing arrangement. Note, the seal 14 and seal carrier 3 are located near the piston 4, and the seal carrier 4 in part defines the space in which the piston 4 floats, but the seal carrier 3 and seal 14 are not part of the piston 4 and are, in this embodiment, not duplicated near the uphole piston. The axial position of the second piston 5 is constrained by shoulders 124 and 126.

FIG. 1 also shows a mandrel catch 142. It is a split component that is installed over element 22B, also known as the mandrel, in two pieces, and then held in place by a snap ring or spring ring. It is not necessary in the design described, but is incorporated into most motors so that in the case of the connection between the mandrel and element 22A, also known as the washpipe, breaking, the bit can still be pulled out of the hole.

While the radial bearings are bushings in the embodiments shown, radial roller bearings could be used instead.

Figure 10:
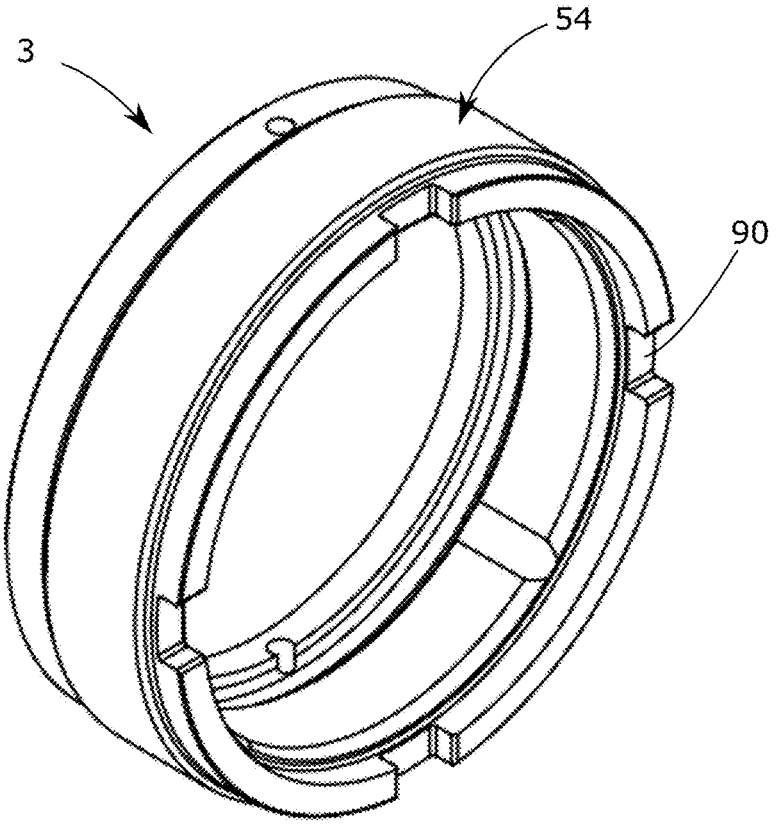
FIG. 10 is an isometric view of a seal carrier showing an axial end of the seal carrier that contacts features of the tooling of FIG. 9.
Figure 12:
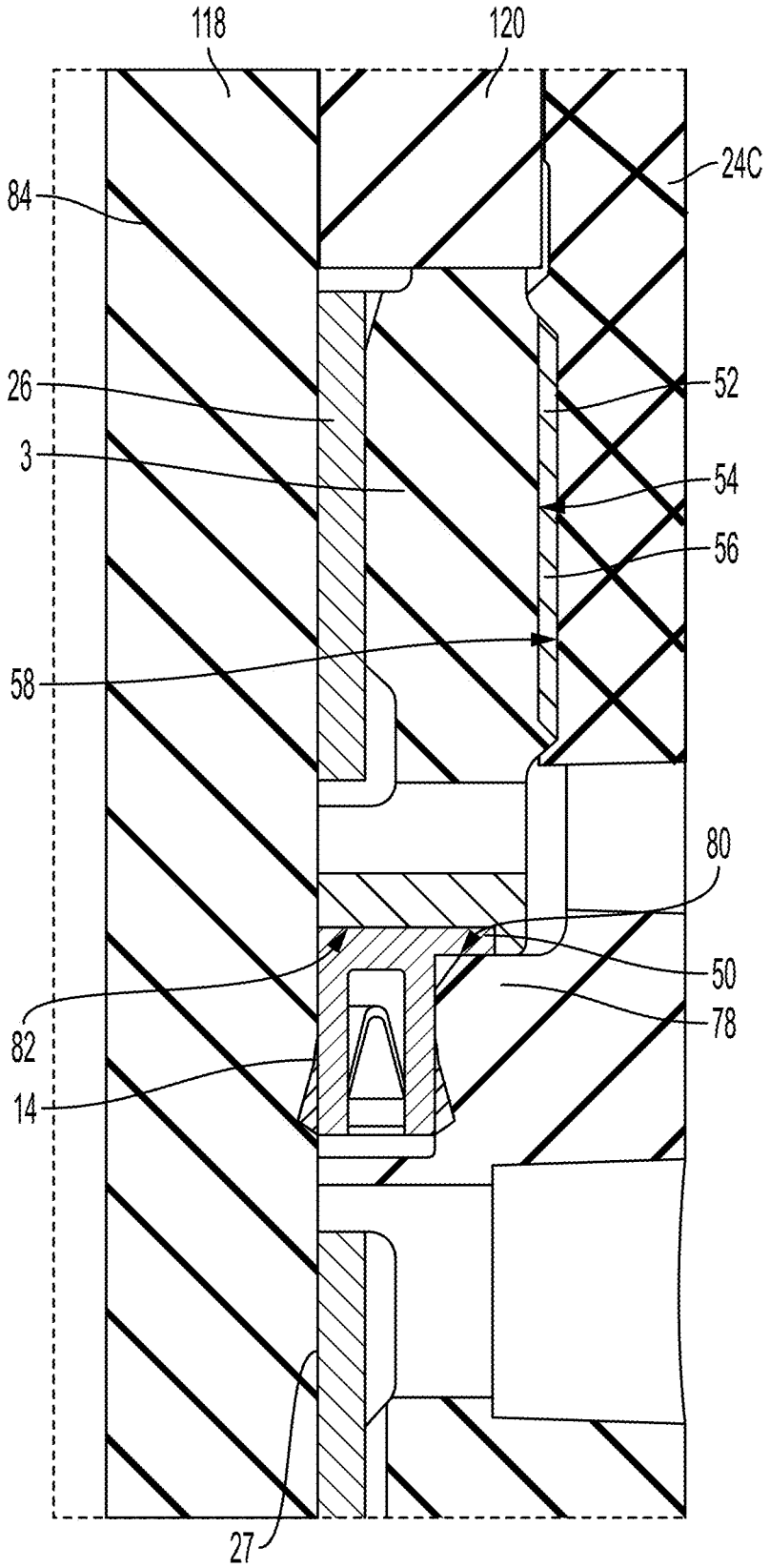
FIG. 12 is a cross section view of the assembly of FIG. 11 inserted within an outer tubular.
Figure 13:
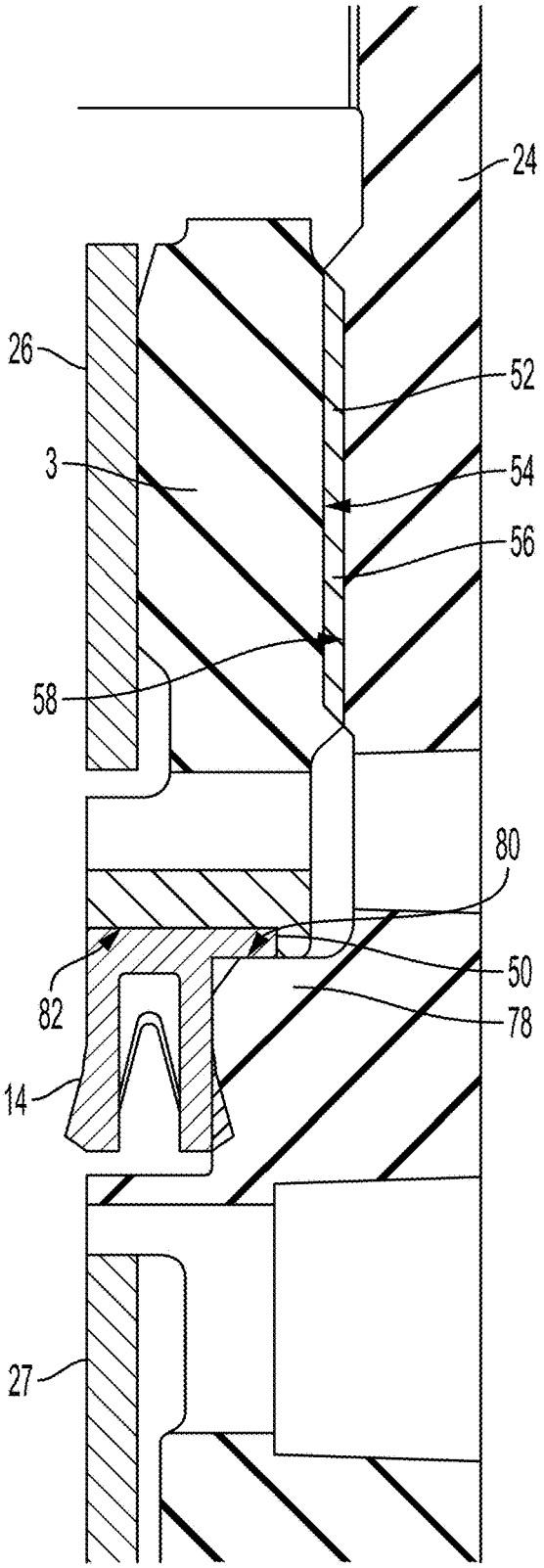
FIG. 13 is a cross section view of the assembly of FIG. 12 with the tooling removed.
Figure 14:
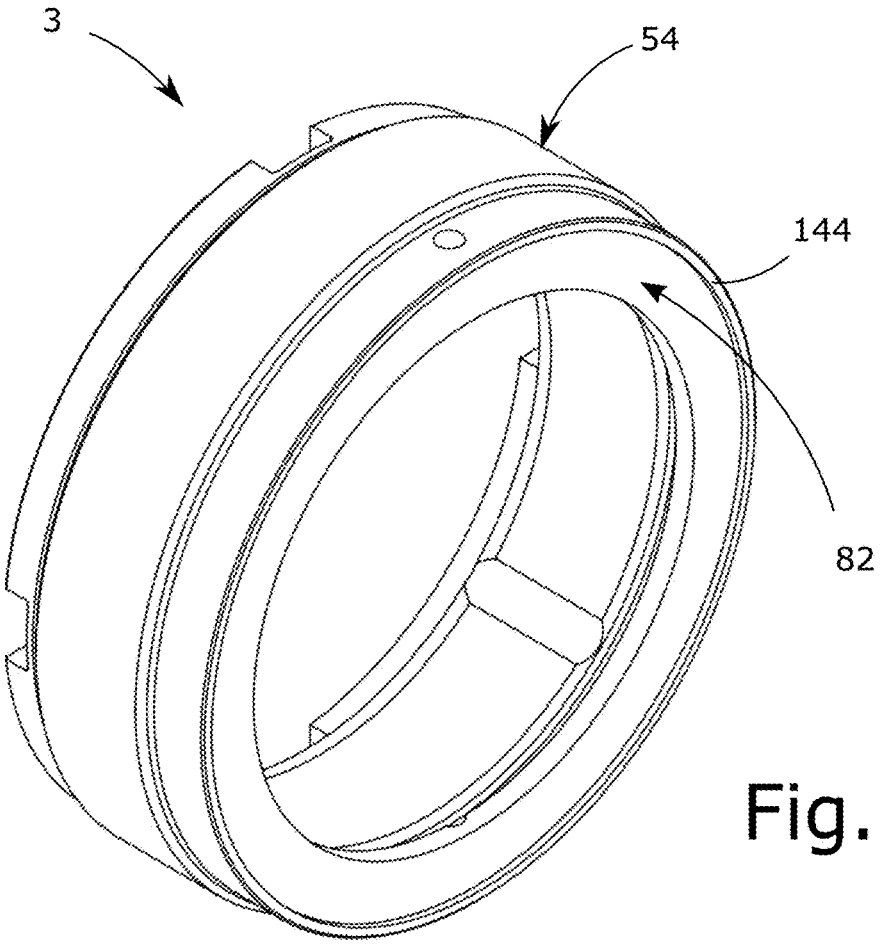
FIG. 14 is an isometric view of the seal carrier of FIG. 10 showing an axial end of the seal carrier that contacts the pressure retaining seal.

The seal carrier 3 is shown in more detail in FIGS. 10 and 14. The seal carrier has a radially outward facing surface 54 which, in an embodiment, may include threading 52 for engaging with threading 56 on an inner surface 58 of the outer tubular to compress the flange. Threading 52 and 56 is not shown in FIGS. 10 and 14 but is shown in FIGS. 12 and 13 by overlap between the seal carrier 3 and outer tubular 24. A sealed bearing system comprising seals and bearings, generally indicated by reference numeral 60 in FIG. 1, may seal between and rotatably connect an outer tubular 32 and an inner tubular 34 telescopically received in the outer tubular. The inner and outer tubulars define an interior bore 62 extending axially within the tubulars. There is a lubricant chamber 64 between the outer tubular and the inner tubular. An outer volume 66 is exterior to the inner and outer tubulars. The sealed bearing system may have thrust bearings 68 within the lubricant chamber for transferring axial loads between the tubulars and a non-pumping seal 14 arranged as a pressure retaining seal within the lubricant chamber to separate the lubricant chamber into a first pressure portion, for example, the lower oil volume 72 and a second pressure portion, for example, the upper oil volume 74. The non-pumping seal may be fixed between a seal carrier 3 and a portion 78 of the outer tubular. Radial bearings 25, 26, 27 within the lubricant chamber may allow for axially aligning the tubulars for coaxial relative rotation. The radial bearings may include a first radial bearing 26 connecting the seal carrier to the inner tubular and a second radial bearing 27 connecting the inner tubular to the outer tubular. The first radial bearing and the second radial bearing may be arranged in opposite axial directions from the non-pumping seal. The radial bearings may, for example, be bushings. A first pressure equalizing element 4 is arranged to substantially equalize a pressure in the first pressure portion to a pressure in the outer volume. The first pressure equalizing element may include a first piston 4 separating the first pressure portion from a first chamber 92 fluidly connected to the outer volume A first end seal 17, 19 seals between the first pressure portion and the outer volume and defines a first end of the lubricant chamber. The first end seal may be mounted on the first piston. The first end seal may include a first wiper seal 19 and a first pumping seal 17. A second pressure equalizing element is arranged to substantially equalize a pressure in the second pressure portion to a pressure in the interior bore. The second pressure equalizing element may include a second piston separating the second pressure portion from a second chamber 94 fluidly connected to the interior bore. A second end seal seals between the second pressure portion and the interior bore and defines a second end of the lubricant chamber. The second end seal may be mounted on the second piston. The second end seal may include a second wiper seal and a second pumping seal. The second radial bearing may be separated from the non-pumping seal by an axial distance less than an axial length of the second radial bearing.

Figure 3:
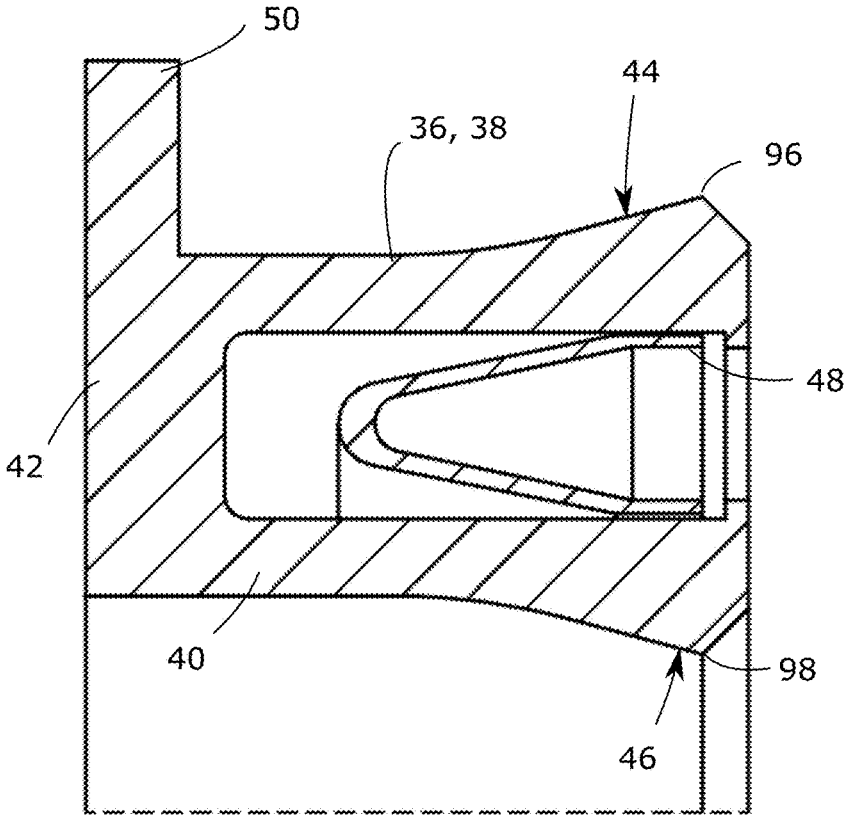
FIG. 3 is a cutaway view of an exemplary pressure retaining seal.

The seal 14 is arranged to provide a pressure retaining seal between outer tubular 32 and inner tubular 34. Inner tubular 34 is coaxial with and arranged for coaxial rotation within the outer tubular 32, using the bearings described above. The seal 14 is configured to extend circumferentially around the inner tubular 34. Embodiments of the seal 14 are shown in more detail in FIGS. 3-8. FIG. 3 shows a cutaway view of a first seal embodiment and FIGS. 4-8 are cross section views of further embodiments. In each of FIGS. 3-8, upwards on the page corresponds to radially outward.

Referring to FIG. 3, an exemplary seal has a cross section comprising a C-shaped portion 36 having outer 38 and inner 40 branches extending from a root portion 42. The outer branch of the C-shaped portion has a contact surface 44 facing an outward radial direction and adapted to stationary contact with the outer tubular. The inner branch of the C-shaped portion includes a sealing surface 46 on a side away from the second branch. The sealing surface 46 faces in an inward radial direction and is adapted to moving contact with the inner tubular. The seal is adapted to have the root portion of the C-shaped portion facing an expected direction of relatively lower pressure in use. The seal has a spring 48 between the outer and inner branches biasing the outer and inner branches apart. A flange 50 extends radially outward from the root portion. The flange is adapted to be compressed by seal carrier 3 against an axially facing surface 80 of the outer tubular to fix the seal with respect to the outer tubular.

Figure 4:
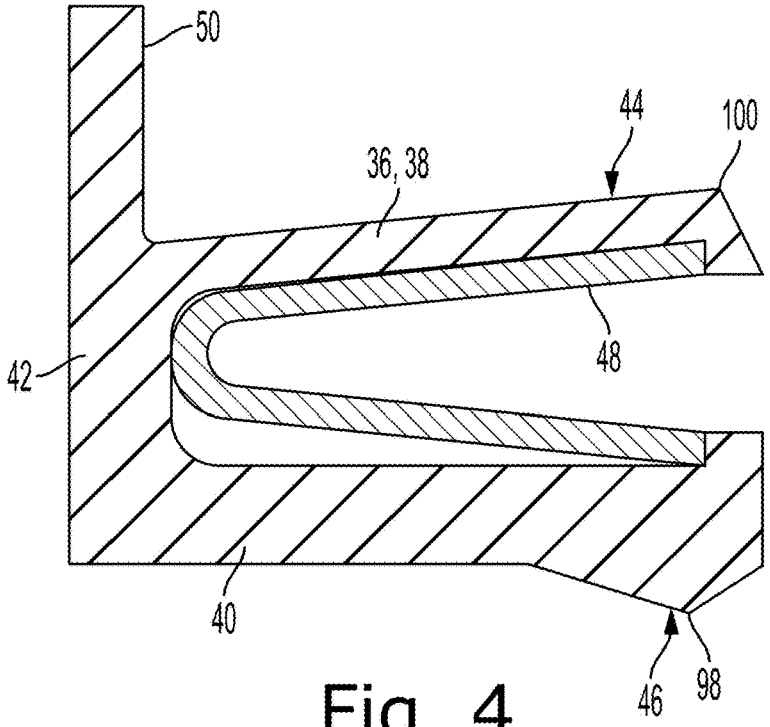
FIGS. 4-8 are respective cross section views of further exemplary pressure retaining seals.
Figure 5:
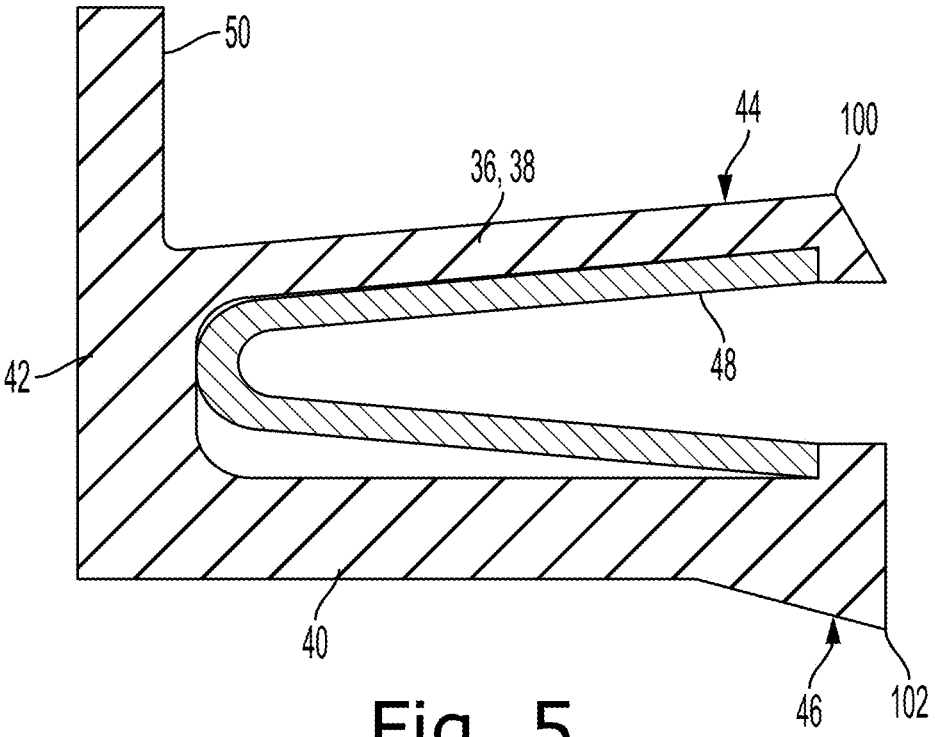
Figure 6:
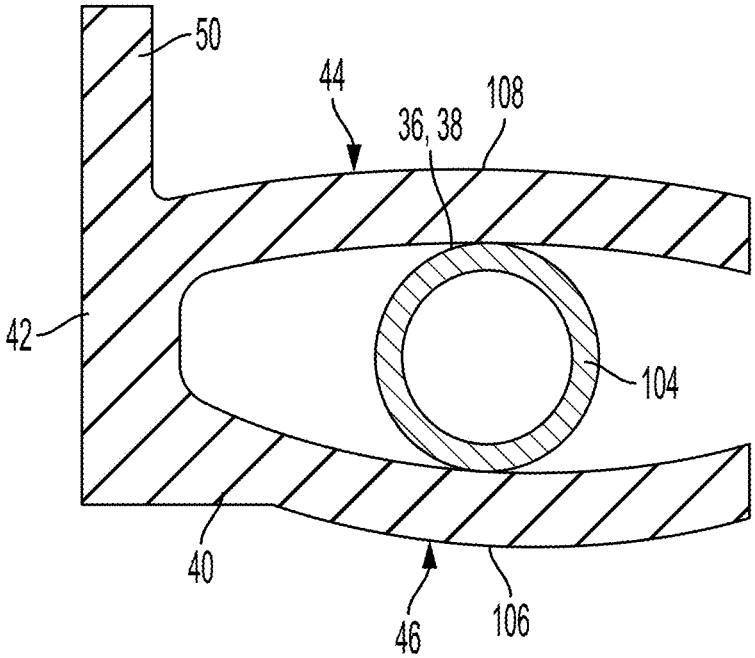

In FIG. 3, the spring 48 is a cantilever spring. In FIG. 3, the contact surface 44 comprises an outer beveled sealing lip 96 and the sealing surface 48 comprises an inner beveled sealing lip 98. In the embodiment of FIG. 4, an outer straight surface 100 is used instead of an outer beveled lip. In the embodiment of FIG. 5, an inner straight triangular lip 102 is used instead of an inner beveled lip. In the embodiment of FIG. 6, a helical coil spring 104 is used in place of the cantilever spring 48, and inner and outer round lips 106 and 108 are used instead of straight or beveled lips.

Figure 7:
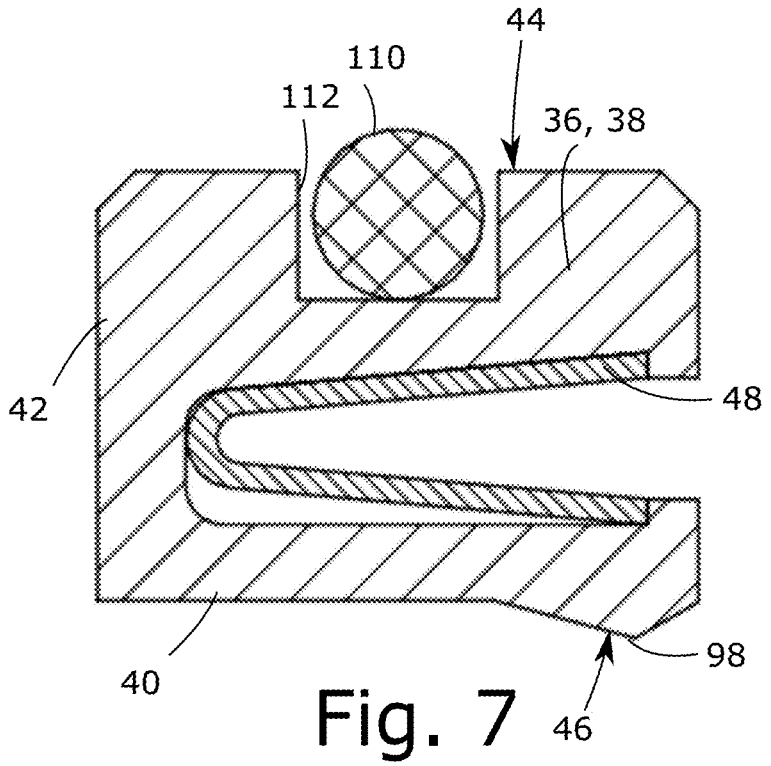
Figure 8:
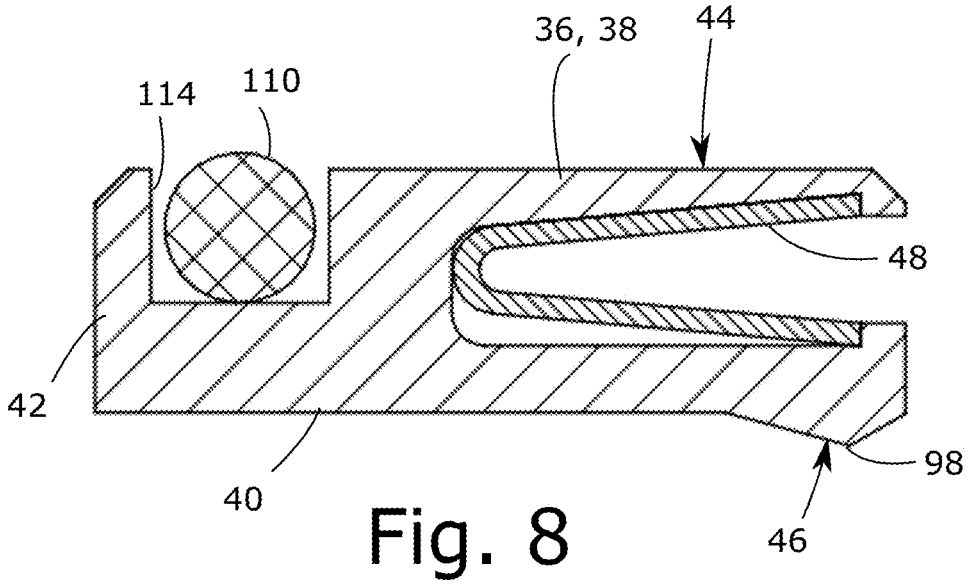

The embodiments of FIGS. 7 and 8 omit the flange 50. The embodiment of FIG. 7 instead has an o-ring 110 mounted in a groove 112 in the contact surface 44. This o-ring contacts the outer tubular when installed to prevent rotation against the outer tubular. This is not believed to be as secure as the flange 50, but may be used as an alternative in the sealed bearing system. In the embodiment of FIG. 8, the o-ring 110 is mounted in a groove 114 in the root portion 42. This is also less secure than the flange, but has the advantage of a lower profile. Fixing the seal by axial compression, for example by axial compression of the flange 50, has an advantage over radial compression in that the axial compression will not become looser as the seal wears radially, and in that the seal may be placed between the inner and outer tubulars before the axial force is applied, making installation easier than if applying a large radial force by interference with the inner or outer tubulars.

Features of FIGS. 3-8 may be combined in various combinations. Optionally, all portions of the seals except the springs and, if present, the o-rings, may be formed of a unitary piece of material, which may for example be polytetrafluoroethylene (PTFE), or PTFE with reinforcement material.

Figure 9:
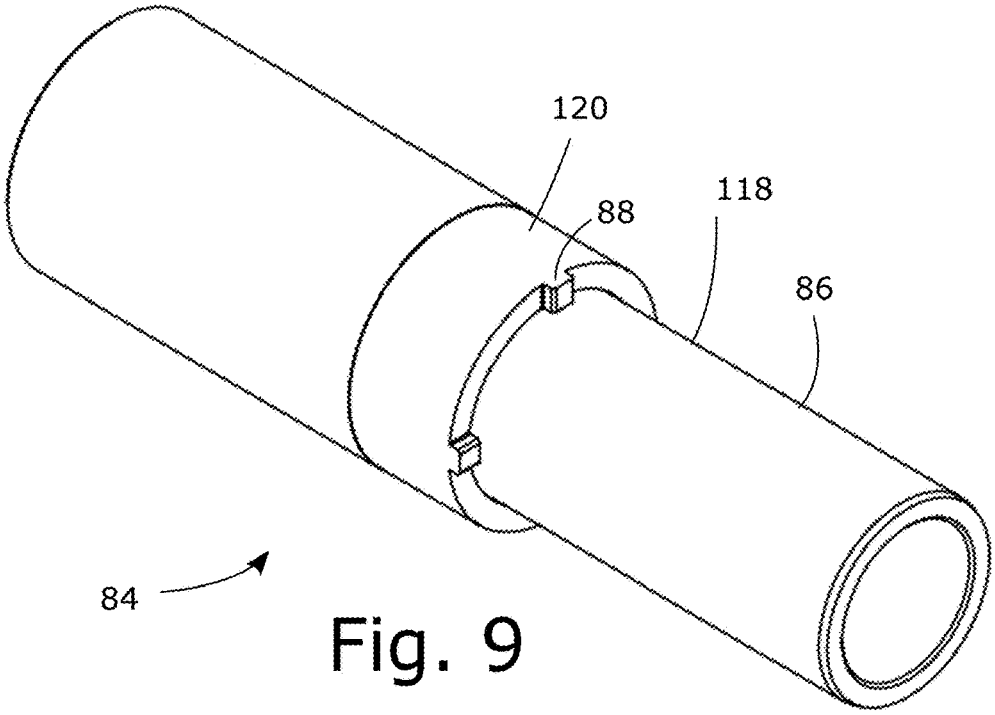
FIG. 9 is an isometric view of tooling used to install a seal carrier and pressure retaining seal in an outer tubular.
Figure 18:
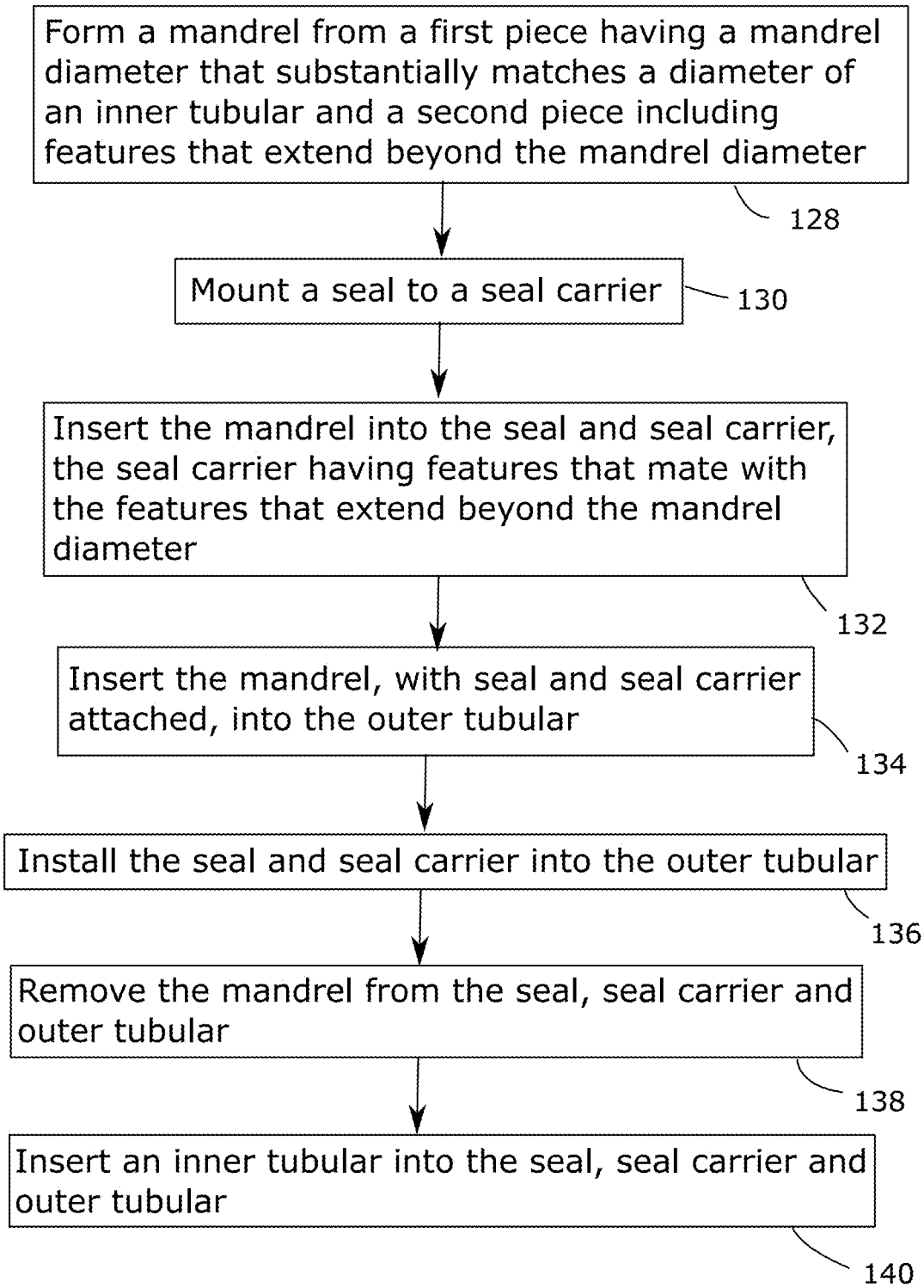
FIG. 18 is a flow chart showing a method of installing a seal carrier.

There is disclosed in FIG. 18 a method of installing a seal in a sealed bearing system, for example a sealed bearing system as disclosed herein, for sealing between inner and outer tubulars that are arranged to relatively rotate coaxially, and where the outer tubular 24 includes defines a portion 80 of a seal gland. The method may include the following steps, and apparatus at various steps is illustrated in FIGS. 9 and 11-13. As an optional initial step 128, a mandrel 84 may be formed as tooling for the method, from a first piece 118 including a portion 86 having a mandrel diameter that substantially matches the diameter of the inner tubular and a second piece 120 including features 88 extending beyond the mandrel diameter. FIG. 9 shows a mandrel 84 formed by this step. The first piece is referred to here as an inner mandrel and the second piece as a torque nut. The inner mandrel 118 is used for centralizing, equipment, and has a portion 86 having a mandrel diameter substantially matching a diameter of the inner tubular. The torque nut 120 has features 88 extending beyond the mandrel diameter mating with corresponding features 90 of the seal carrier.

The mandrel could be formed as one piece but is preferably formed as two pieces as it is difficult to machine the teeth 88 if it is only one piece. Regardless of whether the mandrel 84 is formed by this step or a one piece mandrel is used, a mandrel having a portion 86 having a mandrel diameter substantially matching a diameter of the inner tubular, and features 88 extending beyond the mandrel diameter, is used in subsequent steps. The features extending beyond the mandrel diameter mate with corresponding features 90 of the seal carrier.

Figure 11:
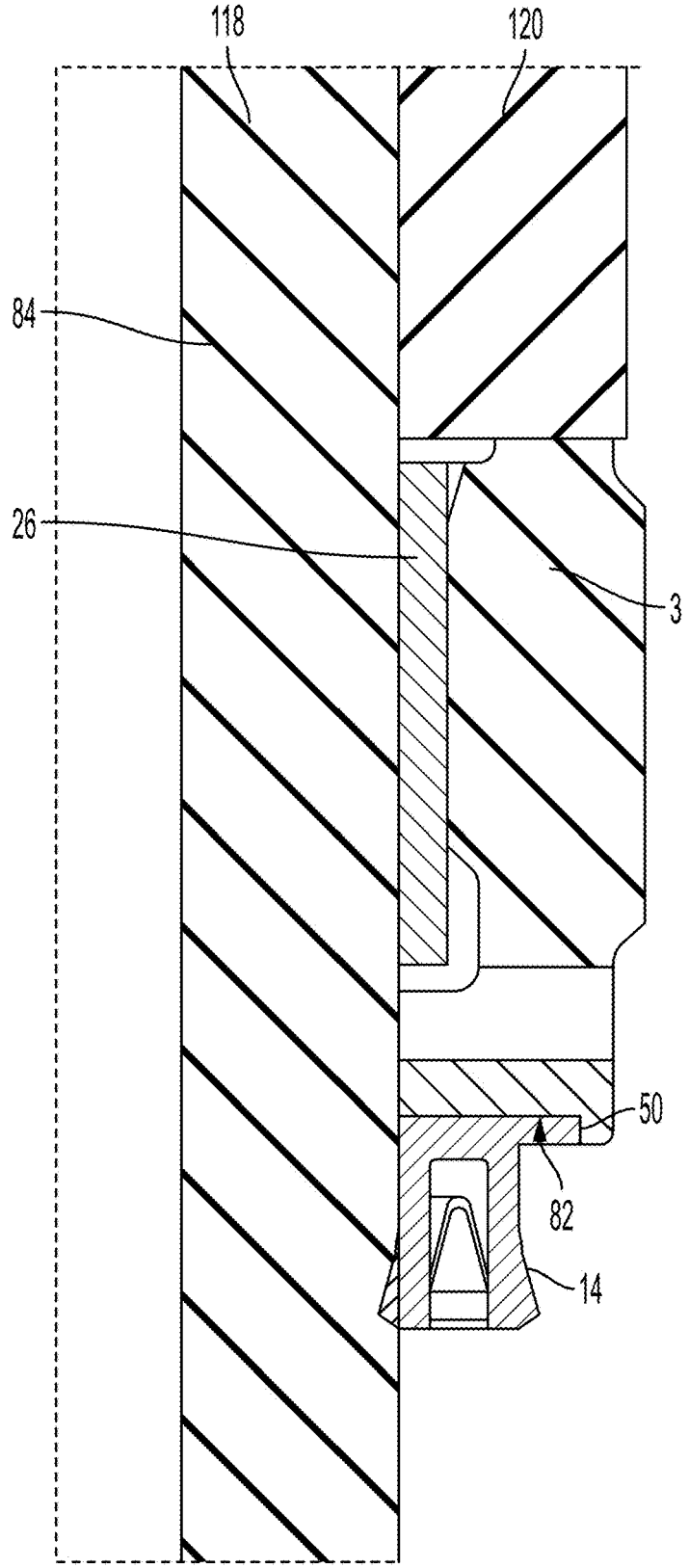
FIG. 11 is a cross section view of a pressure retaining seal and the seal carrier of FIG. 10 mounted on the tooling of FIG. 9.

Referring again to FIG. 18, at step 130, the seal is mounted to the seal carrier 3. The seal carrier defines another portion 82 of the seal gland. At step 132, the mandrel 84 is inserted through the seal and seal carrier. The mandrel seal and seal carrier after step 132 are illustrated in FIG. 11. Note that the "teeth" 88 as shown in FIG. 9 are hard to see in this section view. At step 134, the mandrel is inserted, with the seal and seal carrier mounted to the mandrel, into the outer tubular to install the seal and seal carrier into the outer tubular in step 136. The outer tubular referred to in this step may not be the full outer tubular 24 as shown in FIG. 1, but only a portion, for example 24C. This portion may also be referred to as an "end cap". The mandrel, seal, seal carrier and a portion of the outer tubular after step 136 are shown in FIG. 12. At step 138, the mandrel is removed from the outer tubular, seal and seal carrier. The mandrel may be removed simply by pulling it back axially the way it came. The seal, seal carrier and outer tubular after step 138 are illustrated in FIG. 13. At step 140, the inner tubular is inserted into the outer tubular, seal and seal carrier. With the seal centralized in the end cap and installed securely in its gland, the inner tubular can be installed through the center, and all components will be aligned. As with the outer tubular, the inner tubular here may be a portion of the full inner tubular 22 shown in FIG. 1, for example portion 22B.

Step 136 may be carried out, in one embodiment, by threadably connecting the seal carrier to the outer tubular. The seal carrier 3 may have external threading 52 on outward facing surface 54 arranged to engage threading 56 of an internal threaded portion 58 of the outer tubular. In step 136, the installation may be carried out by rotating the mandrel relative to the outer tubular to cause the external threading of the seal carrier to engage the internal threaded portion of the outer tubular and compress the seal axially between the portion 80 of the seal gland defined by the outer tubular and the portion 82 of the seal gland defined by the seal carrier. Relative rotation may comprise for example rotating the end cap relative to the tooling or the tooling relative to the end cap. In an embodiment, the tooling may be held stationary as the end cap is torque against the seal carrier, with four (could be any number) teeth 88 holding the seal carrier 3 stationary relative to the tooling.

Note that, in the embodiment shown, the two bushings 26 and 27 hold the seal carrier 3 concentric to the end cap 24C, so the assembly is fully aligned.

In a further embodiment, the seal 14 may comprise a flange 50 extending radially outward from the seal, and the step of rotating the mandrel relative to the outer tubular to cause the external threading of the seal carrier to engage the internal threaded portion of the outer tubular and compress the seal axially between the portion of the seal gland defined by the outer tubular and the portion of the seal gland defined by the seal carrier may comprise compressing the flange 50 axially between the portion 80 of the seal gland defined by the outer tubular and the portion 82 of the seal gland defined by the seal carrier.

Any of the seals described above may be used in the method of FIG. 18.

The seal carrier may include, when positioned on the mandrel and when installed within the outer tubular, a bushing 26 to act as a radial bearing against the inner tubular.

Figure 15:
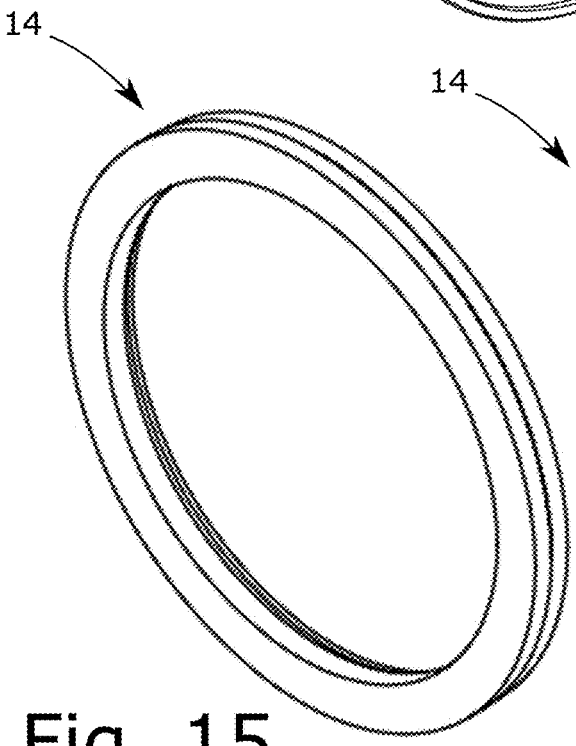
FIG. 15 is an isometric view of a seal formed of a soft material in an undistorted shape.
Figure 16:
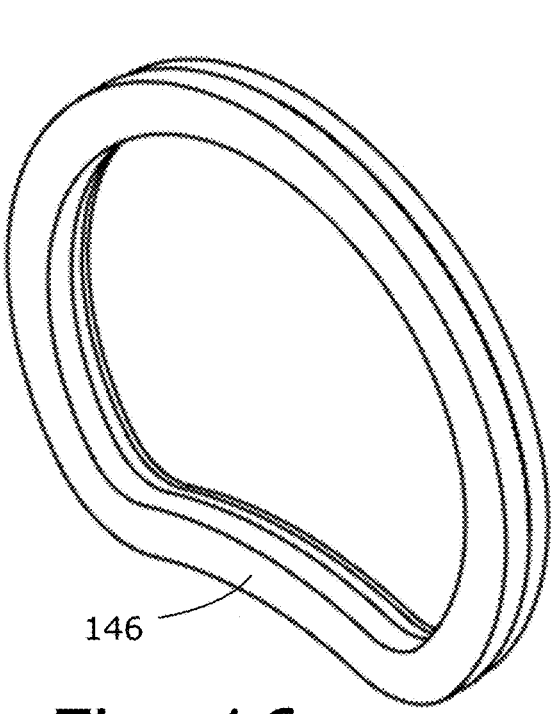
FIG. 16 is an isometric view of a seal formed of a soft material distorted for installation in a one piece groove.

The seal carrier 3 may have a lip 144, as shown in FIG. 14, which may be shaped to define, in combination with surface 82 of the seal carrier and portion 78 of the outer tubular, a groove to hold the seal 14. The seal 14 may be formed of a hard material such as PTFE, such that a large distortion of the seal may damage the seal. The use of this two part groove allows the seal to be installed without such distortion. FIGS. 15 and 16 show how a seal 15 made from a soft material such as Hydrogenated Nitrile Butadiene Rubber (HNBR) may be installed in a groove such as a one part groove. FIG. 15 shows the seal 15 in a resting state. As shown in FIG. 16, the seal 15 may be sufficiently flexible that it can be "folded" inwards forming inward deflected portion 146, making the seal smaller so that it can be inserted into a one part groove.

When a seal is rotating against a shaft, wear can occur on both parts. Usually the softer seal is going to experience the greater portion of the wear.

Figure 17:
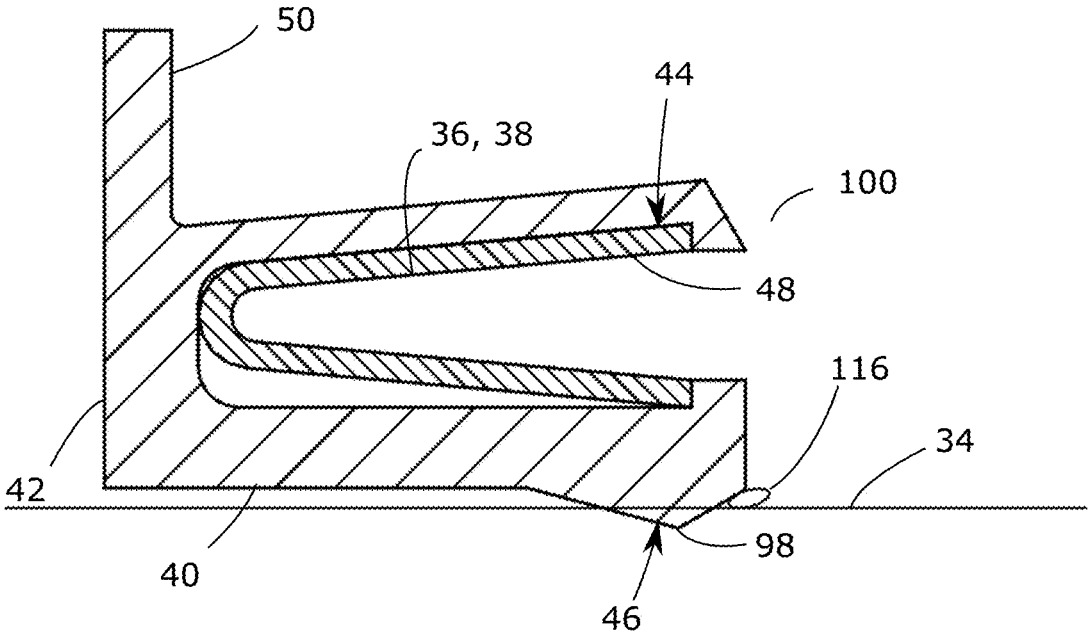
FIG. 17 is cross section view of the pressure retaining seal of FIG. 4 installed in an abrasive environment showing an abrasive particle.

As shown in FIG. 17, in an environment with abrasive particles, the particles 116 can be caught under the seal and become embedded in the softer material. These hard particles are then stationary relative to the soft seal but rubbing against the shaft. This causes wear on the shaft. If the seal is soft, it may not be able to support the particle, and it gets ripped away from the seal, limiting how much it will wear into the shaft. If the seal material is harder, it is more likely to be able to support the particle and cause increased wear against the shaft. The direction of higher pressure would be from the right. Interference between the inner tubular and the sealing surface is shown but would be accommodated in practice by a change in shape of the seal. Therefore, hard seal materials are generally avoided in abrasive environments as they can quickly cause wear into the shaft, and then loose sealing integrity because they can only compensate for a very limited amount of wear. In the sealed bearing system disclosed in this document, this issue is avoided by placing the pressure retaining seal in a non-abrasive environment between end seals.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A sealed bearing system rotatably connecting tubulars comprising:

an outer tubular and an inner tubular, the sealed bearing system sealing between and rotatably connecting the outer tubular and the inner tubular telescopically received in the outer tubular, the inner and outer tubulars defining an interior bore extending axially within the tubulars, a lubricant chamber between the outer tubular and the inner tubular, and an outer volume exterior to the inner and outer tubulars;

thrust bearings within the lubricant chamber for transferring axial loads between the tubulars;

a non-pumping seal arranged as a pressure retaining seal within the lubricant chamber to separate the lubricant chamber into a first pressure portion and a second pressure portion; the non-pumping seal being fixed between a seal carrier and a portion of the outer tubular;

radial bearings within the lubricant chamber for axially aligning the tubulars for coaxial relative rotation, the radial bearings including a first radial bearing connecting the seal carrier to the inner tubular, and a second radial bearing connecting the inner tubular to the outer tubular, the first radial bearing and the second radial bearing being arranged in opposite axial directions from the non-pumping seal;

a first pressure equalizing element arranged to provide pressure balancing between a pressure in the first pressure portion and a pressure in the outer volume;

a first end seal sealing between the first pressure portion and the outer volume and defining a first end of the lubricant chamber;

a second pressure equalizing element arranged to provide pressure balancing between a pressure in the second pressure portion and a pressure in the interior bore; and a second end seal sealing between the second pressure portion and the interior bore and defining a second end of the lubricant chamber.

2. The sealed bearing system of claim 1 in which the radial bearings comprise bushings.

3. The sealed bearing system of claim 1 in which the second radial bearing is separated from the non-pumping seal by an axial distance less than an axial length of the second radial bearing.

4. The sealed bearing system of claim 1 in which the first end seal comprises a first pumping seal and the second end seal comprises a second pumping seal.

5. The sealed bearing system of claim 1 in which the first end seal comprises a first wiper seal and a first pumping seal, and the second end seal comprises a second wiper seal and a second pumping seal.

6. The sealed bearing system of claim 1 in which the first pressure equalizing element comprises a first piston separating the first pressure portion from a first chamber fluidly connected to the outer volume and the second pressure equalizing element comprises a second piston separating the second pressure portion from a second chamber fluidly connected to the interior bore.

7. The sealed bearing system of claim 6 in which the first end seal is mounted on the first piston and the second end seal is mounted on the second piston.

8. The sealed bearing system of claim 1 in which the non-pumping seal is configured to extend circumferentially around the inner tubular member and has a cross section comprising a C-shaped portion having first and second branches extending from a root portion, the first branch of the C-shaped portion having a contact surface facing an outward radial direction and adapted to stationary contact with the outer tubular member, and the second branch of the C-shaped portion including a sealing surface on a side away from the second branch, the sealing surface facing in an inward radial direction and adapted to moving contact with the inner tubular member, the seal adapted to have the root portion of the C-shaped portion facing an expected direction of relatively lower pressure in use; the seal further comprising a spring between the first and second branches biasing the first and second branches apart.

9. The sealed bearing system of claim 8 in which the non-pumping seal further comprises a flange extending radially outward from the root portion; the flange adapted to be compressed by the seal carrier against an axially facing surface of the outer tubular to fix the seal with respect to the outer tubular.

* * * * *